United States Patent [19]

Nishina et al.

[11] 4,192,682

[45] Mar. 11, 1980

[54] PROCESS OF FORMING A HIGH-CONTRAST SILVER IMAGE

[75] Inventors: Yoshio Nishina; Syunji Matsuo; Toshio Nagatani; Kazuo Takahashi; Takeshi Habu, all of Hino, Japan

[73] Assignee: Konishiroku Photo Industry Co., Ltd., Tokyo, Japan

[21] Appl. No.: 869,630

[22] Filed: Jan. 16, 1978

[30] Foreign Application Priority Data

Jan. 26, 1977 [JP] Japan ..... 52-7459

[51] Int. Cl.[2] ..... G03C 5/30

[52] U.S. Cl. ..... 430/405; 430/265; 430/949; 430/546; 430/448; 430/441

[58] Field of Search ..... 96/107, 109, 95, 66 HD, 96/54, 66.3

[56] References Cited

U.S. PATENT DOCUMENTS

| | | | |
|---|---|---|---|
| 2,735,765 | 2/1956 | Loria | 96/109 |
| 3,740,226 | 6/1973 | Dappen | 96/66 HD |
| 3,847,619 | 11/1974 | Bissonette | 96/110 |
| 3,909,268 | 9/1975 | Baldassarri | 96/109 |
| 3,928,043 | 12/1975 | Ciurca | 96/95 |
| 3,957,491 | 5/1976 | Ohi | 96/109 |
| 3,980,479 | 9/1976 | Fields et al. | 96/109 |

FOREIGN PATENT DOCUMENTS

| | | | |
|---|---|---|---|
| 2634666 | 2/1977 | Fed. Rep. of Germany | 96/95 |
| 90120 | 8/1974 | Japan | 96/95 |

*Primary Examiner*—Mary F. Kelley

*Attorney, Agent, or Firm*—Frishauf, Holtz, Goodman & Woodward

[57] ABSTRACT

Process of forming a high-contrast silver image which process comprises treating a light-sensitive silver halide photographic material comprising a support, a silver halide emulsion layer coated thereon and another hydrophilic colloidal layer, at least one of which contains a substantially non-diffusible compound having oxidation power on a hydroquinone developing agent, with a developer containing no hydroquinone developing agent after exposed imagewise.

8 Claims, No Drawings

PROCESS OF FORMING A HIGH-CONTRAST SILVER IMAGE

This invention relates to a novel process of forming a photographic image, especially a novel process for forming a silver image to obtain a photographic image with high-contrast and high-resolving power.

More particularly, this invention relates to a novel process for forming an image which is advantageously applicable to high-contrast light-sensitive silver halide photographic materials for photolithography, X-ray photography for industrial use or reproduction.

There has been known a method of forming extremely high-contrast photographic images using a known light-sensitive silver halide material. For example, there has been known a method of forming a high-contrast image, for example, a dot image negative/positive or line image negative/positive by treating a light-sensitive material comprising a silver chlorobromide or silver chloroiodobromide which is of uniform fine grains having an average grain size of less than 0.5$\mu$ and a narrow size distribution and a high-content of silver halide (at least more than 50 mole percent) with an alkaline hydroquinone in a very small concentration of sulfite ion. Such a high-sensitive silver halide material is known as so-called a lith type light-sensitive material which is essential for the present printing process.

In a process of preparing a halftone image in photolithography, there is generally involved a process of imagewise exposing a lith type light-sensitive material through a cross screen or a contact screen, and then developing the lith type light-sensitive material with a developer called as an infectious or lith type developer. The lith type light-sensitive material itself is not sufficient enough to provide high-contrast. For example, even if it is developed with a non-lith-type developer the gamma is at most 5 or 6 and there is a lot of fringe occurrence which must be avoided in formation of dot. So, it is essential to use the lith type light-sensitive material in combination with said lith type developer for halftone negative/positive use.

Said infectious or lith type developer is described in detail at page 221 of Journal of Franklin Institute, Vol. 239 (1945) by J.A.C. Yule and means a developer of which the developing agent is only hydroquinone and in which the concentration of sulfite ion is low.

As expected from the composition, the lith type developer has a bad storability and is susceptible to auto-oxidation. So, the control system to obtain a high-quality of halftone negative/positive becomes inevitably complicated.

As the merit for improving storability of the lith type developer, a lot of effort has been expended but a developer has not been provided which has storability comparable to Metolhydroquinone which used for continuous gradation, or phenidonehydroquinone, for example, Sakura Dol® type 311, 411 and 431 and which provides high dot quality.

Also, as to light-sensitive silver halide photographic material for facsimile receiving and computerized phototypesetting, a silver iodobromide which is below 0.8$\mu$ of average grain size and in a narrow distribution of grain sizes is used. As is seen in adoption of strong light sources such as a laser probe; high-efficiency of facsimile receiving system and computerized photo typesetting is a great concern for those in the art. Also, high-sensitivity of light-sensitive silver halide photographic materials for facsimile and photo typesetting.

On the other side, as is generally known, making grains gross (large) for highly sensitizing remarkably silver halides causes unfavorable phenomena such as lowering of $\gamma$-value and roughness of image quality. In the light-sensitive silver halide photographic materials for photo typesetting or facsimile, there is not known a method of overcoming this antinomy.

Also, X-ray light-sensitive materials for industrial use need high-contrast. However, producing high-contrast characteristics also results in a silver halide emulsion with low sensitivity. Therefore the development of a process of forming a silver image with high-sensitivity and high-contrast has been strongly desired.

It is, therefore, the first object of this invention to provide a novel process for obtaining high-contrast silver images.

It is the second object of this invention to provide high-contrast silver images by treating a novel light-sensitive silver halide photographic materials for black and white comprising a substantially non-diffusible oxidant as described hereinafter in a hydrophilic colloidal layer.

It is the third object of this invention to provide a process of forming novel high-contrast silver images such as are suitable for obtaining line or dot images available for plate making.

It is the fourth object of this invention to provide a process of forming high-contrast silver image available for X-ray light-sensitive materials for industrial use with high-contrast and high-sensitivity.

It is the fifth object of this invention to provide high-contrast silver images by treating with a developer containing no hydroquinone type developing agent.

The above objects and other objects, which will be described below, of this invention can be effected by treating the light-sensitive silver halide photographic material comprising a support, a silver halide emulsion layer coated on said support and at least one hydrophilic colloidal layer containing a substantially non-diffusible compound having oxidation power on a hydroquinone developing agent, after exposed imagewise, with a developer containing no hydroquinone developing agent.

That is, we have found, after extensive studies to attain the above objects, that the objects can be obtained by processing the light-sensitive silver halide photographic material for black and white comprising a substantially non-diffusible compound having oxidation power on a hydroquinone developing agent in a hydrophilic colloidal layer, after exposed imagewise, with a developer containing a silver halide developing agent other than a hydroquinone.

In this invention, "a compound having oxidation power on a hydroquinone developing agent", as will be in detail described in Reference-1 later, means a compound that when incorporated in a hydrophilic colloidal layer (especially a gelatin layer) results in a positive surface oxidation-reduction potential of said hydrophilic colloidal layer containing said compound in a buffer solution containing said developing agent against a surface oxidation reduction potential of the hydrophilic colloidal layer (especially gelatin layer) not containing said compound in said buffer solution containing said developing agent.

Further, it is preferred that for the purpose that the oxidation power of said compound of this invention is sufficiently effective, the oxidation-reduction potential of said compound in a pH of 10.0 is 80 mV, especially 100 mV, higher than that of hydroquinone.

Also in this invention, a substantially non-diffusible compound means a compound that can not be diffused out in a processing solution from the light-sensitive photographic material during development, and, in concrete terms, a compound such as does not diffuse from the hydrophilic colloidal layer (especially gelatin layer) in an aqueous solution in a concentration of over several percentage, preferably over 2%, in cases where said hydrophilic colloidal layer (especially gelatin layer) containing said compound is immersed in an aqueous solution having the same ionic strength and the same pH as the developer described below at a temperature such as is applicable for the developer, for example, at a temperature of 20° to 40° C. for 10 minutes.

But said compound may be more diffusible within the scope of the effect of this invention.

Typical examples of substantially non-diffusible compounds having oxidation power on the said hydroquinone type developing agents according to this invention will be exemplified as follows, but they are not to be construed in a limiting manner.

1. Quaternary salts of nitrogen (a) Quaternary salts according to this invention are preferably salts of tetrazolium having the following formulas [I], [II] or [III]:

Formula [I] :

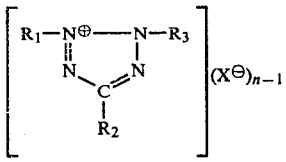

Formula [II] :

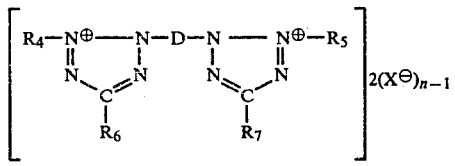

Formula [III] :

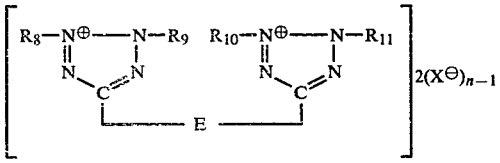

wherein $R_1$, $R_3$, $R_4$, $R_5$, $R_8$, $R_9$, $R_{10}$ and $R_{11}$ each represent an alkyl, allyl, phenyl, naphthyl or heterocyclic group and may be a group forming a metal chelate or a complex; $R_2$, $R_6$ and $R_7$ each represent an allyl, phenyl, naphthyl, heterocyclic, alkyl, hydroxyl, carboxyl or the salt thereof, amino, mercapto, nitro group or a hydrogen atom; D represents a divalent arylene group such as phenylene or naphthylene; E represents an alkylene, allylene or aralkylene group; $X^{\ominus}$ represents an anion preferably a surfactant having at least 9 carbon atoms; n represents an integer of 1 or 2 providing that when the compound forms a molecular inner salt, n is 1. Preferably said anionic surfactant is represented by the general formulas [IV], [V], [VI], [VII] or [VIII].

Formula [IV] :

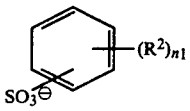

wherein $R^2$ represents an alkyl group including alkyl and substituted alkyl; and $n_1$ is an integer of 1 to 3. Examples of the anionic surfactant represented by the formula [IV] are:

4-iso-propylbenzenesulfonate
2,3,5-triethylbenzenesulfonate
4-dodecylbenzenesulfonate
4-(2-fluoro)-hexylbenzenesulfonate Formula [V] :

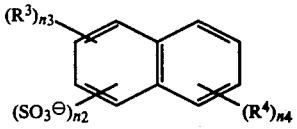

wherein $R^3$ and $R^4$ each represent hydrogen, an alkyl group including alkyl and substituted alkyl, $n_2$, $n_3$ and $n_4$ are individually an integer of 1 to 3. Examples of the anionic surfactant represented by the general formula [V] are:

1,5-di-iso-propylnaphthalene-4-sulfonate
2,6-di-tert-amylnaphthalene-4-sulfonate
1,5-di-iso-propylnaphthalene-4,8-di-sulfonate
2,4-di-methyl-6-n-propylnaphthalene-8-sulfonate
1,5-di-(2-chloropentyl)-naphthalene-4-sulfonate Formula [VI] :

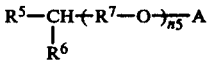

wherein $R^5$ and $R^6$ individually represent hydrogen, an alkyl group including alkyl and substituted alkyl, $R^7$ represents an ethylene group including an ethylene and substituted ethylene and propylene group including propylene and substituted propylene, $n_5$ is an integer of 5 to 200 (preferably 10 to 100), A represents a $-SO_3^{\ominus}$ and $-COO^{\ominus}$ group. Examples of the anionic surfactant represented by the general formula [VI] are:

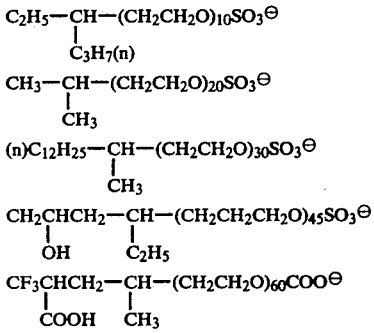

Formula [VII] :

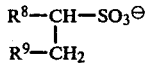

wherein $R^8$ represents hydrogen, an alkyl group including alkyl and substituted alkyl, an alkyloxycarbonyl group including alkyloxycarbonyl and substituted alkyloxycarbonyl; $R^9$ represents an alkyl group including alkyl and substituted alkyl and an alkyloxycarbonyl group including alkyloxycarbonyl and substituted alkyloxycarbonyl. Examples of the anionic surfactant represented by the general formula [VII] are:

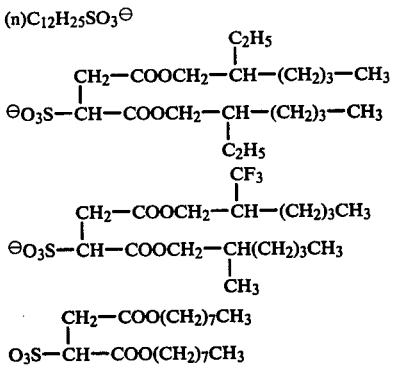

Formula [VIII] :
$R^{10}—COO^{\ominus}$ wherein $R^{10}$ represents a saturated or an unsaturated alkyl group including alkyl and substituted alkyl. Examples of the anionic surfactant represented by the general formula [VIII] are:

$n\text{-}C_{11}H_{23}COO^{\ominus}$
$n\text{-}C_{17}H_{35}COO^{\ominus}$
$CH_3(CH_2)_7CH{=}CH(CH_2)_7COO^{\ominus}$ The examples of the tetrazolium cation part are:

2-(Benzothiazol-2-yl)-3-phenyl-5-dodecyl-2H-tetrazolium
2,3-Diphenyl-5-(4-t-octyloxyphenyl)-2H-tetrazolium
2,3,5-Triphenyl-2H-tetrazolium
2,3,5-Tri(p-carboxyethylphenyl)-2H-tetrazolium
2-(Benzothiazol-2-yl)-3-phenyl-5-(o-chlorophenyl)-2H-tetrazolium
2,3-Diphenyl-2H-tetrazolium
2,3-Diphenyl-5-methyl-2H-tetrazolium
3-(p-Hydroxyphenyl)-5-methyl-2-phenyl-2H-tetrazolium
2,3-Diphenyl-5-ethyl-2H-tetrazolium
2,3-Diphenyl-5-n-hexyl-2H-tetrazolium
5-Cyano-2,3-diphenyl-2H-tetrazolium
2-(Benzothiazol-2-yl)-5-phenyl-3-(4-tolyl)-2H-tetrazolium
2-(Benzothiazol-2-yl)-5-(4-chlorophenyl)-3-(4-nitrophenyl)-2H-tetrazolium
5-Ethoxycarbonyl-2,3-di(3-nitrophenyl)-2H-tetrazolium
5-Acetyl-2,3-di(p-ethoxyphenyl)-2H-tetrazolium
2,5-Diphenyl-3-(p-tolyl)-2H-tetrazolium
2,5-Diphenyl-3-(p-iodophenyl)-2H-tetrazolium
2,3-Diphenyl-5-(p-diphenyl)-2H-tetrazolium
5-(p-Bromophenyl)-2-phenyl-3-(2,4,6-trichlorophenyl)-2H-tetrazolium
3-(p-Hydroxyphenyl)-5-(p-nitrophenyl)-2-phenyl-2H-tetrazolium
5-(3,4-Dimethoxyphenyl)-3-(2-ethoxyphenyl)-2-(4-methoxyphenyl)-2H-tetrazolium
5-(4-Cyanophenyl)-2,3-diphenyl-2H-tetrazolium
3-(p-Acetamidophenyl)-2,5-diphenyl-2H-tetrazolium
5-Acetyl-2,3-diphenyl-2H-tetrazolium
5-(Fur-2-yl)-2,3-diphenyl-2H-tetrazolium
5-(Thien-2-yl)-2,3-diphenyl-2H-tetrazolium
2,3-Diphenyl-5-(pyrid-4-yl)-2H-tetrazolium
2,3-Diphenyl-5-(quinol-2-yl)-2H-tetrazolium
2,3-Diphenyl-5-(benzoxazol-2-yl)-2H-tetrazolium
2,3-Diphenyl-5-nitro-2H-tetrazolium
2,2',3,3'-Tetraphenyl-5,5'-1,4-butylene-di-(2H-tetrazolium)
2,2',3,3'-Tetraphenyl-5,5'-p-phenylene-di-(2H-tetrazolium)
2-(4,5-Dimethylthiazol-2-yl)-3,5-diphenyl-2H-tetrazolium
3,5-Diphenyl-2-(triazin-2H-tetrazolium
2-(Benzothiazol-2-yl)-3-(4-methoxyphenyl)-5-phenyl-2H-tetrazolium, etc.

or other cation parts of tetrazolium compounds such as are disclosed in Chemical Review, 55 355–483 (1955).

(b) triazolium compounds having the formula; $[T]^{\ominus}(X^-)_n$ $[T]^{\oplus}$ represents triazolium compound; $X^-$ represents as same as described in previous term (a), n is 1. Examples of T are:

1-Methyl-2-phenyl-2H-1,2,3-triazolium
1-n-Propyl-2-phenyl-2H-1,2,3-triazolium
2-(4-methoxyphenyl)-3-phenyl-2H-naphtho-[1,2-d]-1,2,3-triazolium
1,5-(9,10-anthraquinolyl)-bis-{2-[3-phenyl]-2H-naphtho-[1,2-d]-1,2,3-triazolium}
2,3-di(4-methoxyphenyl)-5-nitro-2H-naphtho-[1,2-d]-1,2,3-triazolium (c) bipyridinium compounds having the formula; $[B]^{2+}(X^-)_2$ $[B]^{2+}$ represents bipyridinium compound, $X^-$ represents as same as described in previous term (a). Examples of B are:

1,1'-Dimethyl-4,4'-bipyridinium
1,1'-Diethyl-4,4'-bipyridinium
1,1'-Dibenzyl-4,4'-bipyridinium By making an appropriate selection of anion and cation part, the substantially non-diffusible compounds having oxidation power on hydroquinone developing agents according to this invention can be prepared.

The non-diffusible oxidant thus obtained are, for example, 2,3,5-triphenyl-2H-tetrazolium dioctyl succinate sulfonate salt etc. As will be illustrated in detail in Examples, these compound can be incorporated into gelatin matrix either by dissolving the respective soluble salt in gelatin and then mixing them or by synthesizing the pure crystalline oxidant, dissolving it in a suitable solvent such as dimethylsulfoxide, and then dispersing it into gelatin matrix. When the dispersion is difficult to be uniform, it is useful to use suitable homogenizers, such as ultrasonic or colloid mill homogenizers.

2. N-chloroarylsulfonamide compounds represented by the general formula:

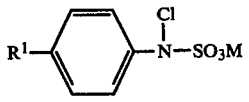

wherein $R^1$ represents an alkyl group including alkyl and substituted alkyl having 6 to 12 carbon atoms and M represents an alkali metal atoms such as sodium, potassium and so forth. Examples of the compounds represented by the general formula are:

N-chloro-p-dodecylbenzenesulfonamide sodium
N-chloro-p-nonylbenzenesulfonamide sodium 3. Metal complex compounds represented by general formula:

$M'\text{-}Z]^{n'\oplus}(X^{\ominus})_n,$

M' represents metal, n' is integer of 2 to 5, Z represents ligands which form metal complex compound, ($X^{\ominus}$) represents as same as described in previous term 2. Examples of $[M'-Z]^+$ above are: hexaammine cobalt (III), triethylenediamine cobalt (III), bis(diethanolamine) cobalt (III), hexaammine chromium (III), bis(dipropanolamine) chromium (III), bis(ethylenediamine) trimethylenediamine cobalt (III); ethylenediamine tetraacetic acid iron (III); etc. These compounds can be used like quaternary nitrogen salts by making salts of these compound with anion parts as described in above quaternary nitrogen salts.

4. Other non-diffusible inorganic oxidants: tetraphenylphosphonium bichromate, tetraphenylphosphonium permanganate, tetraphenylarsonium perchromate, etc.

The light-sensitive silver halide photographic material can be incorporated with at least one non-diffusible oxidant but may be incorporated with two or more non-diffusible oxidants in combination.

Among non-diffusible oxidants according to this invention, quaternary salt oxidants, N-chloroallylsulfonamide sodium type compounds, N-haloimide type compounds and tetrazolium compound can be preferably used in this invention. Especially the compound composed of 2,3,5-triphenyl-2H-tetrazolium and diisopropylnaphthalenesulfonic acid, and 2,3,5-triphenyl-2H-tetrazolium and diethylhexyl succinate sulfonic acid.

The layer that can be incorporated with the non-diffusible oxidant according to this invention is a hydrophilic colloidal layer, preferably a silver halide emulsion layer and/or a gelatin layer adjacent to said silver halide emulsion layer. That is, in a preferable embodiment of this invention, the non-diffusible oxidant can be incorporated into a silver halide emulsion layer or the layer containing a silver halide emulsion. In another preferable embodiment, said non-diffusible oxidant can be incorporated into a layer directly adjacent to the silver halide emulsion layer or a layer containing the silver halide emulsion, or into a hydrophilic colloidal layer, especially gelatin layer, adjacent but separated by another hydrophilic colloidal layer (intermediate layer). According to another embodiment, said non-diffusible oxidant which is dispersed oil-protectedly using the solvent disclosed in, for example, U.S. Pat. Nos. 2,322,027 and 2,533,514 can be incorporated into a hydrophilic colloid layer.

The non-diffusible oxidant are generally stable under any coating conditions used by those in the art and substantially non-diffusible under development treating conditions.

According to one of preferred embodiments of this invention, the hydrophilic colloidal layer which is incorporated with an ion pair of tetrazolium ion and diethylhexyl succinate sulfonic acid (hereinafter, referred to as DES) ion shows remarkable ultra high-contrast in comparison with that obtained in the same way by coating with diffusible tetrazolium chloride. But according to the analysis described hereinafter, an elution of the former, that is, the ion pair of tetrazolium and DES from the light-sensitive silver halide photographic material into the processing solution is less than several percent, thus showing that the compound of this invention is substantially non-diffusible.

According to another embodiment of non-diffusible oxidants of this invention, a hydrophilic colloidal layer which is incorporated with an ion pair of hexaammine cobalt (III) ion and DES anion and adjacent to the silver halide emulsion layer give an ultra high-contrast image in comparison with that obtained in the same way coated with hexaammine (III) chloride. According to the same analysis, the pair of hexaammine cobalt (III)-DES is a substantially non-diffusible during development process.

The compounds according to this invention are preferably used in a range of 0.0001 to 10 moles, preferably over 0.001 mole per one mole of silver of the light-sensitive silver halide photographic material.

Some prior art for the improvement of various kinds photographic characteristics by incorporating a oxidant or compound having oxidizing power into a silver halide light-sensitive material has been known and such are disclosed in such Patents as U.S. Pat. Nos. 3,503,741 and 3,909,268 and Provisional Patent Publication (hereinafter, referred to as PPP) No. Sho 49-5333/1974, etc. But the present invention is different in terms of concrete settlement and action and effect from this prior art. Therefore, the present invention is based on a different technical idea from them. For example, the invention disclosed in U.S. Pat. No. 3,503,741 concerns a silver-dye-bleach process and a process of improving a decrease in effective sensitivity which is a defect in the silver-dye-bleach process. According to the disclosure of the specification, a colorless tetrazolium salt dye precursor contained in a silver halide light-sensitive material is developed to form a dye, and thereafter followed by a silver-dye-bleach process.

The fact that the tetrazolium salt used here is a kind of oxidant is similar to this invention. But, the invention disclosed therein relates to a process of obtaining color image. Therefore, the tetrazolium salt is used as a color image forming substance and finally a reversal dye color image is obtained. These points are essentially different from this invention in the object, constitution and effect. Also in U.S. Pat. No. 3,909,268 there is disclosed a silver halide light-sensitive material containing tetrazolium-o-oxybetaine compound, but the compounds are all diffusible compounds. This point is different from this invention using non-diffusible compounds. Therefore, according to the process disclosed therein, the same object as that in this invention cannot be achieved and deterioration of photographic characteristics such as decrease in a maximum density occurs. It is still impossible to obtain a good dot quality with a development process using a developer not belonging to lith type developer. There is disclosed in PPP No. Sho 49-5333 the fact that sensitization can be achieved by treating a lith type light-sensitive material with a solution containing an oxidant before development.

Also in the specification of U.S. Pat. No. 3,977,879, there is disclosed that improvement of sensitization and dot quality can be effected by incorporating iodide or an iodate into a layer adjacent to the emulsion layer and treating it with a lith type developer. But all oxidants incorporated in these light-sensitive elements are diffusible and different from non-diffusible oxidants used in this invention. Therefore, the same object as this invention can not be accomplished. Further in these invention, the effect of high-contrast can not be achieved when treated with so-called MQ or PQ development. Also in the above Research Disclosure No. 10,908, there is disclosed a light-sensitive material incorporated with a metal compound such as chromium or cobalt and ammonia trimethylenediamine or diethanolamine into a light-sensitive element containing silver chloroiodobromide emulsion. It is said that this light-sensitive material, by incorporation further with azaindene, shows better characterics and give high-contrast even without using a harmful cadmium salt. Also there is disclosed therein that in said metal complex compound ion pairs such as chlorides, bromides and perchlorates can be used. But these compounds are liable to diffuse compared with non-diffusible oxidants used in this invention and incorporation of said compound into a light-sensitive silver halide photographic material does not show remarkable high-contrast such as this invention and therefore dot quality improvement can not be expected. On the contrary, bad affects such as desensitization during storage occur and there has not been developed an effective measure for avoiding these defects which results in a problem for practical use.

But in the process of incorporating a non-diffusible oxidant according to this invention into a hydrophilic colloidal layer, the use of a developer containing no hydroquinone developing agent gives better desensitizing characteristic of dot images than that of a hydroquinone developer and not only side exposure characteristics is better, but also extremely better dot quality is obtained even when treated with a developer containing no hydroquinone developing agent in which extremely high-contrast, that is, known lith developing characters such as a color developer or a photographic paper developer, would not to be expected.

Further in BP 1,214,982 there is disclosed the fact that cobalt salts can be used in a extremely low concentration as stabilizer and anti-fogants. But in cases where the cobalt salt is added in a high concentration to a silver halide photographic emulsion, and especially when a water-soluble cobalt salt is used, a remarkable desensitization occurs and it is also impossible to accomplish the object of this invention. Recently, U.S. Pat. No. 3,765,891, there is disclosed a process of incorporating a cobalt (III) ion complex in a high concentration to a photographic element. Another process is also disclosed in Research Disclosure Nos. 10927 and 10926 and U.S. Pat. No. 3,847,619. But in each process, remarkable desensitization results and the improvement of high-contrast and especially the improvement of the dot qualities can not be expected and is not disclosed. And most of these examples concern light-sensitive color photographic materials. On the contrary, in cases where the light-sensitive black-white silver halide photographic material containing an anion pair of a substantially non-diffusible Co (III) compound according to this invention is treated with a developer containing other developing agents than a hydroquinone developing agent such as para-aminophenol, Metol, phenylenediamine, Phenidone, ascorbic acid, etc. in single or in combination of several agents, without any remarkable desensitization, an unexpected and extremely high-contrast silver image can be obtained. And still more astonishing is that excellent dot silver images can be obtained without using a lith type developer. In this way, in all this prior art which is applicable to a light-sensitive silver halide photographic material containing a compound having oxidizing power, their object or concrete constitution is different from that of this invention and a process of obtaining remarkable high-contrast effect and/or forming excellent dot images without using the lith type development has not been found before this invention.

On the contrary, in the process of forming high-contrast silver image according to this invention, there can be obtained unexpected and surprising results that the use of a developer containing a developing agent other than a hydroquinone developing agent results in superior desensitizing characteristics of dot image quality and extremely better side exposure characteristics than the use of a developer containing a hydroquinone developing agent. This is unexpected from the case of the use of a hydroquinone developing agent in single as well as from the treatment of using so-called MQ or PQ developer containing a supplementary developer.

The light-sensitive silver halide photographic material according to this invention is composed of at least one light-sensitive silver halide emulsion coated on a support. Also, on the light-sensitive silver halide photographic material, another hydrophilic colloidal layer can be provided on the support together with said light-sensitive silver halide emulsion layer. Further in a preferred embodiment of the light-sensitive silver halide photographic material used in this invention, a hydrophilic colloidal layer, especially a protecting layer consisting of gelatin can be provided on the outermost layer of the hydrophilic colloidal layer containing the light sensitive silver halide emulsion layer coated on the support.

Light-sensitive silver halide photographic materials which are used for this invention can be any of known silver halides such as silver bromide, silver chlorobromide, silver iodobromide, silver chloro-iodo-bromide and silver chloride and so forth, all of which are used in usual silver halide photographic emulsions. These silver halides may be of worse or fine grains and can be prepared by any known method such as is disclosed in U.S. Pat. Nos. 2,592,250, 3,276,877, 3,317,322, 2,222,264, 3,320,069, 3,206,313 or J. Phot. Sci., 12 242-251 (1964). Further, the silver halides prepared by different methods may be used by mixing them. The grain size distribution of the silver halide emulsion used in the present invention is preferred to be comparatively uniform and an average grain size is preferred to be within a range of about 0.05 to about 1.5μ. But at all events this range is of cause much broader than that used in known lith light-sensitive material. In the silver halide emulsions according to this invention, soluble salts are preferred to be removed but may be used without removing them.

The silver halide emulsions according to this invention may be sensitized with one or more of various chemical sensitizers such as active gelatin, sulfur sensitizers, e.g. sodium thiosulfate, allylthiocarbamide, thiourea and allylisocyanate, selenium sensitizers, e.g. N,N-dimethyl-selenourea and serenourea, reduction sensitizers, e.g. triethylenetetramine and stannic chloride, and noble metal sensitizers, e.g. potassium chloroaurite, potassium aurithiocyanate, potassium chloroaurate, 2-aurosulfobenzothiazole methyl chloride, ammonium chloropalladate, potassium chloroplatinate and sodium chloropalladite. In the case of using gold sensitizers, ammonium thiocyanate can be used as an aid. Further, the silver halide emulsions may be optically sensitized with one or more of sensitizing dyes so as to have sensitivity in a desired region of sensitive wave length. Various kinds of sensitizing dyes can be used, but the preferred sensitizing dyes are such as cyanines, merocyanines, three or four nucleus merocyanines, three or four nucleus cyanines, styriles, halopolarcyanines, hemicyanines, oxonols and hemioxonols. These optical sensitizers may contain, as heterocyclic ring nucleus at a part of them, nuclei such as basic radicals, e.g. thiazoline and thiazole, nuclei containing such as rhodanine, thiohydantoine, oxazolidinedione, barbituric acid, thiobarbituric acid and pyrazolone and these nuclei may be substituted with alkyl, hydroxyalkyl, halogen, phenyl, cyano or alkoxy radicals and condensed with aryl or heterocyclic ring. The silver halide emulsions may be stabilized with compounds which are disclosed in U.S. Pat. Nos. 2,444,607, 2,716,062, 3,512,982, German Pat. No. 1,189,380, U.S. Pat. Nos. 3,726,686, 3,717,465, PP No. Sho 43-4133/1968, U.S. Pat. No. 3,342,596, Patent Publication (referred to as PP) NO. Sho 47-4417/1972, BP 1,363,921, PP Nos. Sho 39-2825/1964, 49-13566/1974 and preferred compounds are such as 5,6-trimethylene-7-hydroxy-s-triazolo(1,5-a) pyrimidine, 5,6-tetramethylene-7-hydroxy-s-triazolo(1,5-a) pyrimidine, 5-methyl-7-hydroxy-s-triazolo(1,5-a)pyrimidine, 7-hydroxy-s-triazolo(1,5-a)pyrimidine, 5-methyl-6-bromo-7-hydroxy-s-triazolo(1,5-a)pyrimidine, galic acid esters (e.g. isoamyl gallate, dodecyl gallate, propyl gallate and sodium gallate), mercaptans (e.g. 1-phenyl-5-mercaptotetrazole, 2-mercaptobenzothiazole), benzotriazoles (e.g. 5-bromobenzotriazole, and 4-methylbenzotriazole) and benzoimidazoles (e.g. 6-nitrobenzoimidazole). In the silver halide emulsions according to this invention, latent image stabilizers of amino acid compounds containing sulfur such as are disclosed in BP 1,343,904 and U.S. Pat. No. 3,821,295 and gradation regulators such as cadmium and rhodium salt can be used but sufficient high-contrast light-sensitive materials can be obtained in this invention without using gradation regulators. In order to enhance contrast in silver halide emulsion, a method of using rhodium or cadmium salts are heretofore known and are disclosed in BP 775,197, U.S. Pat. No. 3,488,709, etc. In the case of use of rhodium salts, its optimum added amount is in an extremely small quantity and extremely narrow in its range, so that the products are apt to vary widely and some problems remain unsettled for preparing stable light-sensitive material. On the other hand, in the case of use of cadmium salts, only an extremely small amount should be added because of adverse ecological effects. In the case of film treatment, the cadmium salt should be finally washed off, so they contaminate the surroundings. Cadmium salt are known to hinder metabolism and to be harmful to ecological systems. Cadmium can be detected not only in the air but also in body of marine animals. In a view of the toxicity of cadmium and a trace of other metals and in consideration of public health and usual ecological balance, this invention has provided a novel method of obtaining sufficient high-contrast light-sensitive materials without using harmful metals.

In the hydrophilic colloids according to this invention, there can be incorporated if necessary, any photographic additives in a range such as not to impair the effect of this invention. These are gelatin plasticizers, hardening agents, surface active agents, image stabilizers, antistaining agents, pH adjusters, antioxidants, antistatic agents, viscosity increasing agents, granularity improving agents, dye, mordant, brightening agents, development regulators, matting agents and the like.

Among the said additives, preferred additives are as follows: viscosity increasing agents or plasticizers such as are disclosed in U.S. Pat. No. 2,960,404, PP No. Sho 43-4939/1968, OLS 1,904,604, U.S. Pat. No. 3,656,956, PPP No. Sho 48-63715/1973, PP No. Sho 45-15462/1970, Bel. P 762,833, U.S. Pat. Nos. 3,767,410 and 3,692,753, for example, copolymer of styrene and sodium maleate and dextran sulfate; image stabilizers are 6,6'-butylidenebis(2-t-butyl-4-methylphenol) and 4,4'-methylenebis(2,6-di-t-butylphenol) and the like. As surface active agents which are used as permiability improving agents of coating aids, emulsifying agents and treatment liquid, antifoggants or controller of several physical characters in light-sensitive materials, anionic, cationic, non-ionic or amphoteric compounds can be used which are disclosed in BP 548,532, 1,216,389, U.S. Pat. Nos. 3,026,202, 3,514,293, PP Nos. Sho 44-26580/1969, 43-17922, 17926, 13166/1968, 48-20785/1973, FP 202,588, U.S. Pat. No. 3,726,683, FP 2,174,112; mordant such as are disclosed in U.S. Pat. Nos. 2,113,381, 2,548,564 and the like; antistain agents such as are disclosed in U.S. Pat. Nos. 2,360,210, 2,728,659, 2,732,300, 3,700,453, e.g. 2-methyl-5-hexadecylhydroquinone, 2-methyl-5-sec-octadecylhydroquinone and 2,5-di-t-octylhydroquinone; antistatic agents such as are disclosed in U.S. Pat. No. 3,573,093, PPP No. Sho 48-89979/1973, U.S. Pat. Nos. 2,882,157, 2,972,535, PPP No. Sho 48-20785/1973, BP 1,378,584, PPP No. Sho 48-90391/1973, PP Nos. Sho 46-24159/1971, 49-64/1974, U.S. Pat. Nos. 3,549,369 and 3,663,230 and PPP No. Sho 47-33627/1972; matting agents such as are disclosed in BP 1,221,980, U.S. Pat. Nos. 2,992,101, 2,956,884, FP 1,395,544 and BP 1,307,373, especially silica gel having 0.5–20μ in diameter and a polymer of polymethyl acrylate of 0.5–20μ in diameter; as development accelerators, such compounds as those containing the benzylalcohol polyoxyethylene group, and the addition polymer of polyoxyethylene and glycidol may be used and added effectively in a treatment bath.

The light-sensitive silver halide photographic materials according to this invention may be coated on a suitable photographic support in the form of silver halide emulsion containing the said several photographic additives and other hydrophilic colloidal layer. The supports used for this invention are baryta paper, paper coated with polyethylene, polypropylene synthetic paper, glass plate, cellulose acetate, cellulose nitrate, polyester film such as polyethylene terephthalate, polyamide film, polypropylene film, polycarbonate film, polystyrene and the like. These supports can be adequately chosen according to the intended use of the light-sensitive photographic materials.

The images obtained by treating the light-sensitive silver halide photographic material, after being exposed imagewise, with one of the developers has high-contrast silver images, so this invention can be applicable to several fields requiring high-contrast black-white records. The light-sensitive silver halide photographic materials used in this invention are preferably applicable to, for example, lith type light-sensitive materials, facsimile receiving light-sensitive materials, computer typesetting light-sensitive materials, copying light-sensitive materials, micro light-sensitive materials, reproduction light-sensitive materials, industrial X-ray light-sensitive materials, etc., and have excellent characteristics which have not been achieved in prior light-sensitive materials for forming dot images. That is, even if the sulfite ion concentration in the developer used for treating the light-sensitive silver halide photographic material according to this invention is increased, better dot images can be obtained, so that there can be contained in said developer sulfite ion contents enough sufficient to make it difficult or to make it almost impossible for the developer to be subject to auto-oxidation.

In said sulfite ion there can be contained sodium sulfite, potassium sulfite, ammonium sulfite, etc.

The hydrophilic colloidal layer incorporated with a non-diffusible oxidant of this invention is preferred to regulate membrane characteristics and the technique called hardening usually applies in this case.

Examples of hardening agents used for hardening treatment of emulsion are formaldehyde, glutaraldehyde; aldehyde compound such as dialdehyde of polydextrose disclosed in PP No. Sho 45-9578/1970; ketone compounds such as diacetyl and cyclopentanedione; bis(2-chloroethylurea), 2-hydroxy-4,6-dichloro-1,3,5-triazine; active halogen containing compounds such as are disclosed in U.S. Pat. Nos. 3,288,775 and 2,732,303, BP 974,723 and 1,167,207, divinylsulfone, 5-acetyl-1,3-diacyloylhexahydro-1,3,5-triazine and 1,3,5-triacycloyl-1,3,5-triazine; reactive olefin compounds such as are disclosed in U.S. Pat. Nos. 3,635,718 and 3,232,763 and BP 994,869; N-hydroxymethylphthalimide; N-methylol compounds such as are disclosed in U.S. Pat. Nos. 2,732,316 and 2,586,168; isocyanate such as are disclosed in U.S. Pat. No. 3,103,437; aziridine compounds such as are disclosed in U.S. Pat. Nos. 3,017,280 and 2,983,611; acid derivatives such as are disclosed in U.S. Pat. Nos. 2,725,294 and 2,725,295; carbodiimide compounds such as are disclosed in U.S. Pat. No. 3,100,704; epoxy compounds such as are disclosed in U.S. Pat. No. 3,091,537; isoxazole compounds such as are disclosed in U.S. Pat. Nos. 3,321,313 and 3,543,292; halogenocarboxyaldehydes such as mucochloric acid; dioxanes such as dihydroxydioxane and dichlorodioxane or chrome alum or zirconium sulfate as inorganic hardening agents.

Instead of above compounds there can be used compounds acting as precursors such as alkali metal bisulfide aldehyde adducts, methylol derivatives of hydantoin and primary aliphatic nitroalcohols.

To regulate swelling of the hydrophilic colloidal layer according to this invention, the following procedures can be adopted; to coat a thin polymer layer on the light-sensitive element such as is disclosed in U.S. Pat. No. 3,502,501 and PP No. Sho 45-33468/1970; to incorporate water-insoluble polymers such as are disclosed in PP Nos. Sho 45-18415 and 45-19951/1970 into the hydrophilic colloidal layer; to incorporate one of the following materials into the light-sensitive element and the hydrophilic layer (gelatin layer) composed of the light-sensitive element at a concentration such as is not detrimental to the effect of this invention; water-soluble polymer such as are disclosed in BP 523,661, GP 2,255,711 and 2,046,682 and U.S. Pat. No. 3,341,332; phenylcarbamyl gelatin, acylated gelatin and phthalylated gelatin such as are disclosed in U.S. Pat. Nos. 2,614,928 and 2,525,753; graft-polymers of polymerisable monomer having a ethylene group such as styrene, acrylic acid, acrylate, methacrylic acid and methacrylate with gelatin such as are disclosed in U.S. Pat. Nos. 2,548,520 and 2,831,767.

Also, the weight ratio of silver in the light-sensitive layer and the hydrophilic colloidal binder can be adopted at an extremely broad range to achieve the object of this invention, but the weight ratio of the hydrophilic colloidal binder is preferably 0.05 to 3 times, more particularly 0.1 to 1 time that of silver. Further, the amount of the coated silver can be adequately adopted according to sizes of silver halide grains, composition and characteristics of the object and the characteristics of this invention can not be dependent on the coated silver amount. But in the case of lith sensitive-materials, the amount is generally at a range of 5–200 mg, particularly preferable at a range of 15–80 mg per 100 $cm^2$.

The developer used in this invention is a developer comprising a developing agent other than a hydroquinone developing agent.

As to the developing agents used in this invention, any compound (except hydroquinone developing agents) capable of reducing silver halides can be generally used and typical examples of the compound are following organic and inorganic compounds:

[Inorganic developing agent]

Fe(II), Ti(III) and V(II) ions and the complexes thereof, for example, EDTA-Fe(II) salt, $(C_2O_4)_2Fe(II)$ salt, $(C_6H_5O_7)_3Fe(II)$ salt and bis(1-hydroxy-3-methylcyclopentadienyl)Fe(II) salt, and copper complexes such as $Cu(NH_3)_2^-$, dithionite such as $Na_2S_2O_4$ and compounds having organic substituents such as hydroxylaminehydrazine, phenylhydrazine, hydrazobenzene and phenylhydroxylamine.

[Organic developing agents]

The compounds represented by the following formula (A) are preferably used:

Formula (A)

$$R_1'\text{-}Z\text{-}R_2'$$

wherein Z is an arylene group including arylene and substituted arylene such as phenylene, naphthylene and phenylene or naphthylene substituted with the group consisting of hydroxyl, alkyl (such as methyl, ethyl, propyl) carboxyl, halogen (such as chlorine bromine acetamido, alkoxy (such as methoxy, ethoxy), amino, hydroxybenzoyl, phenyl; $R_1'$ and $R_2'$ are individually hydroxyl or an

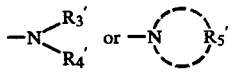

in which $R_3'$ and $R_4'$ each represent hydrogen, hydroxyl, an alkyl group including alkyl and substituted alkyl such as methyl, ethyl, propyl, or alkyl substituted with the group consisting of alkoxy, aryloxy, hydroxyl, alkylacylamino, arylacylamino, alkylsulphonamido, arylsulphonamido, alkylcarbamoyl, arylcarbamoyl and carboxyl; $R_5'$ represents a non-metallic atomic group for forming 5- or 6-membered heterocyclic ring, the atomic group being such as morpholino, tetrahydrofurfuryl, piperidine.

Typical examples of this type are catechol, pyrogallol ascorbic acid, p-aminophenol or, heterocyclic ring type compounds and the like and are the following compounds:

Catechol (Compound A),
4-Chlorocatechol (Compound B),
3-Phenylcatechol
4-Phenylcatechol
3-Methoxycatechol
4-Acetylpyrogallol (Compound C)
4-(2'-Hydroxybenzoyl)pyrogallol,
Sodium ascorbate (Compound D) except hydroquinone developing agents,
4-Aminophenol (Compound E)
2-Amino-6-phenylphenol (Compound F)
2-Amino-4-chloro-6-phenylphenol
4-Amino-2-phenylphenol 4-Methylaminophenol ½ sulfate salt,
3,4-Diaminophenol
3-Methyl-4,6-diaminophenol,
2,4-Diaminoresorcinol
2,4,6-Triaminophenol
N-Methyl-p-aminophenol (Compound G)
N-β-Hydroxyethyl-p-aminophenol
p-Hydroxyphenylaminoacetic acid (glycine for photographic use),
1,2-Aminonaphthol
4-Amino-2-methyl-N,N-diethylaniline
2,4-Diamino-N,N-diethylaniline
N-(4-amino-3-methylphenyl)morpholine,
p-Phenylenediamine
4-Amino-N,N-dimethyl-3-hydroxyaniline
N,N,N',N'-Tetramethylparaphenylenediamine
4-Amino-N-ethyl-N-(β-hydroxyethyl)-aniline
4-Amino-3-methyl-N-ethyl-N-(β-hydroxyethyl)aniline (Compound H)
4-Amino-N-ethyl-(β-methoxyethyl)-3-methylaniline
4-Amino-3-methyl-N-ethyl-N-(β-methylsulfonamidoethyl)-aniline
4-Amino-N-butyl-N-γ-sulfobutylaniline
1-(4-Aminophenyl)-pyrolidine
6-Amino-1-ethyl-1,2,3,4-tetrahydroquinoline,
9-Aminojulolidine
1-Phenyl-3-pyrazolidone (Compound I)
1-Phenyl-4-amino-5-pyrazolidone
1-(p-Aminophenyl)-3-amino-2-pyrazoline
1-Phenyl-3-methyl-4-amino-5-pyrazolone
5-Aminouracil and
5-Amino-2,4,6-trihydroxypyrimidine.

Other developing agents such as are disclosed in pages 278–311 of The Theory of the Photographic Process, Third Edition by C. E. K. Mees., T. H. James and J. Am. Chem. Soc., 73, 3100 (1951) can be effectively used in this invention. These developing agents can be used single but the combined use of two or more of these agents brings about excellent results and a small amount of hydroquinone can be added into them at a range such as is not detrimental to the effect of this invention. As preservatives used in this invention, there can be used sulfite such as sodium sulfite, potassium sulfite and ammonium sulfite, hydroxylamine, hydrazine, sugars and their derivatives without impairing the effect of this invention. This is one of the distinguishing features of this invention. It is also optional to control pH value of the developer and provide a buffer function by adding alkali hydroxides, alkali carbonates or amines which are used in ordinary black-white developers and to add inorganic development inhibitors such as potassium bromide and organic development inhibitors such as benzotriazole.

In the case of developing the light-sensitive silver halide photographic material of this invention, after exposure, with a developer which meets the above conditions, there are involved several embodiments: for example, the developing temperature is preferably below 50° C. and particularly near 30° C.; the development time is generally within 30 minutes and particularly preferable within 5 minutes; treatments after development such as water washing, stopping, stabilization and fixing and further prehardening and neutralization may be optionally applicable and these treatments can be omitted according to circumstances. These treatments can be carried out by means of manual developments such as bath development and frame development or by means of mechanical development such as roller development and hanger development. Further, addition of additives such as contrast controlling agents which are used in conventional high-contrast developers does not give any bad effect on photographic image produced by using the present invention.

The non-diffusible oxidants of this invention are preferred to be incorporated into the hydrophilic colloidal layer, as described above but this invention is not limitative to this. For example, the non-diffusible oxidants of this invention can be incorporated into the light-sensitive silver halide photographic material by dissolving the oxidant into a suitable organic solvent and directly coating the solution on the outermost surface of the light-sensitive materials by means of an overcoat method or on the outermost surface of the light-sensitive material during preparation.

This invention will be hereinafter illustrated by examples but these are not meant to limit the scope of this invention and several modifications thereof may be possible. Hereinafter are disclosed references, preparative examples of non-diffusible oxidants of this invention and comparative examples.

Reference—1

The following samples were prepared:

Sample A

Sample A was prepared by coating a photographic support with a gelatin aqueous solution so as to have 200 mg of the coated amount per 100 $cm^2$.

Sample B

In the above gelatin solution were added a 5% aqueous solution of 2,3,5-triphenyltetrazolium chloride (hereinafter, referred to as T-salt) and a 5% aqueous solution of DES by means of a double-jet method to obtain an ion pair of T-salt-DES. The ion pair solution was then coated on a polyethyleneterephthalate support in order that 200 mg of gelatin containing 30 mg calculated in terms of T-salt can be coated per 100 $cm^2$ of the support.

On the other hand, to a buffer solution having pH 7.0 (ionic strength: 0.1) containing potassium dihydrogen phosphate and sodium hydroxide was dissolved $1.0\times10^{-3}$ mol/l of the hydroquinone developing agents disclosed in Table 1 and this solution was added to the Samples A and B in an amount as small as possible. The surface oxidation-reduction potential (mU) of Sample B which was higher than that of Sample A was measured by using a platinum electrode and saturated calomel electrode as the comparative electrode. The results were listed in Table 1.

Table 1

| Difference between the oxidation and reduction potentials of Samples B and A | Developing agents | | |
|---|---|---|---|
| | Hydroquinone | Chlorohydroquinone | t-Butylhydroquinone |
| (25° C.) | 58 mV | 62 mV | 57 mV |

It is evident from Table 1 that several hydroquinone developing agents were oxidized with the substantially nondiffusible oxidant.

Reference—2

The sample was prepared by coating a gelatin aqueous solution containing an ion pair consisting of T-salt and DES prepared according to preparative Example—1 to a polyethylene terephthalate support so as to cover 50 mg of gelatin/100 $cm^2$ and about 20 mg of the ion pair of T-salt and DES/100 $cm^2$ calculated in terms of T-salt and then drying.

Then, the diffusibility of this ion pair in a developer was examined by quantitatively measuring the remaining ion pair amount after the above sample was immersed into a developer having the following composition at 30° C. for 10 minutes:

| Developer composition | | |
|---|---|---|
| Metol | 3.5 | g |
| Anhydrous sodium sulfite | 60 | g |
| Hydroquinone | 9.0 | g |
| Sodium carbonate monohydrate | 54.0 | g |
| Potassium bromide | 2.5 | g |
| 5-Nitrobenzoimidazole | 0.5 | g |
| 1-Phenyl-5-mercaptotetrazole | 10 | mg |
| Water to make | 1 | l |
| pH = 10.25 | | |

The ion pair amount of T-salt and DES remaining in the sample was measured quantitatively as an amount of T-salt as follows:

The gelatin of 10 cm×10 cm in the sample was decomposed with a 0.1% pronase solution and sodium sulfide was added to this solution to reduce T-salt to formazan dye which was completely extracted with chloroform. The chloroform solution containing this formazan dye was measured colorimetrically using 480 nm wave length.

The results were listed in Table 2 for comparison.

Table 2

| Sample | An amount of T-salt mg/100 $cm^2$ |
|---|---|
| The untreated sample | 2.03 |
| The sample immersed into the developer | 2.00 |

Then, the decreasing rate smaller amount of T-salt in treated sample was calculated by the following equation:

$$\text{Decreasing rate} = \frac{[\text{T-salt amount in the untreated sample}] - [\text{T-salt amount in the treated sample}]}{[\text{T-salt amount in the untreated sample}]} \times 100$$

$$= \frac{2.03 - 2.00}{2.03} \times 100 = 1.48[\%]$$

This result showed clearly that the ion pair of T-salt and DES according to this invention was not dissolved out in the treatment liquid during development and was a substantially non-diffusible compound.

Next, typical preparative examples of substantially non-diffusible compounds applicable preferably to this invention will be illustrated as follows.

Preparative Example—1

After 37 g of inactive gelatin was completely swollen by cold water, 150 ml of 6.7% T-salt aqueous solution and 270 ml of 5% sodium diisopropylnaphthalenedisulfonate (hereinafter, referred to DIPN) aqueous solution were added to the above solution simultaneously within 5 minutes at 50° C. under vigorous stirring by means of a double-jet method and after further 30 minutes stirring, water was added to make 1 l in whole.

Preparative Example—2

To 100 ml of a 10% gelatin solution at 40° C. were added 20 mg of a 5% hexaamminecobalt (III) chloride solution and 60 ml of a 10% DES solution with vigorous stirring within two minutes by means of a double-jet method. After further 30 minutes stirring, water was added to make 250 ml in whole.

Preparative Example—3

This was prepared in the same way as in Preparative Example—1 to obtain the desired ion pair except that DES was used instead of DIPN.

Preparative Example—4

This was prepared in the same way as in Preparative Example—1 to obtain the desired ion pair except that 3-(p-hydroxyphenyl)-5-methyl-2-phenyl-2H-tetrazolium chloride instead of T-salt and sodium p-dodecylbenzenesulfonate instead of DIPN were used.

Preparative Example—5

This was prepared in the same way as in Preparative Example—1 to obtain the desired ion pair except that 1,1'-dimethyl-4,4'-bipyridium was used instead of T-salt.

Preparative Example—6

To 50 ml of water at 50° C. were added simultaneously 150 ml of a 6.7% T-salt solution and 270 ml of a 5% DIPN solution with vigrous stirring within 3 minutes to obtain a yellowish white precipitate, which was dried under reduced pressure.

Comparative Example—1

A silver chloro-bromo-iodide gelatin emulsion with an average grain size of 0.25μ containing 90 moles % of chloride, 9 moles % of bromide and 1 mole % of iodide was chemically sensitized using sulfur and gold sensitizers. To this emulsion was added oleinic acid ether of polyethylene glycol (molecular weight=1540) in a ratio of 200 mg per 1 mole of silver. This emulsion was then coated on a polyethylene terephthalate support so as to cover 50 mg of silver/100 $cm^2$ and 35 mg of coated gelatin/100 $cm^2$. Further, on this silver halide emulsion layer was coated gelatin in an amount of 15 mg/100 $cm^2$ as a protective layer. This sample was wedge-exposed through a gray-contact screen with tungsten lamp and treated as follows (the treatment temperature: 30° C.)

| | | |
|---|---|---|
| Development | 3 minutes | 30 seconds |
| Stopping | | 30 seconds |
| Fixing | 2 minutes | |
| Water washing | 5 minutes | |
| Drying | | |

The treating baths were composed of the following composition:

| [Developer composition] | | |
|---|---|---|
| Hydroquinone | 15 | g |
| Formaldehyde sodium hydrogen sulfite | 50 | g |
| Sodium sulfite | 2 | g |
| Boric acid | 8 | g |
| Sodium carbonate monohydrate | 85 | g |
| Potassium bromide | 2.5 | g |
| Water to make | 1 | l |
| pH = 10.0 | | |

-continued

| [Fixing solution] | | |
|---|---|---|
| Ammonium thiosulfate decahydrate | 150 | g |
| Anhydrous sodium sulfite | 10 | g |
| Sodium acetate trihydrate | 15 | g |
| Glacial acetic acid | 15 | ml |
| Water to make | 1 | l |
| pH = 4.20 | | |

Example—1

The sample of the light-sensitive silver halide photographic material was prepared in the same way as in Comparative Example—1. But in this example an ion pair composed of 1 g of 2,3,5-triphenyltetrazolium chloride and Alkanol C (Surface active agent available from Du Pont Company per 1 mole of silver was added to the sensitive material before coating. Then, the above sample was exposed in the same way as in Comparative Example—1 and treated with the following treatments:

| [Treatment] (at 30° C.) | |
|---|---|
| Development | 3 minutes 30 seconds |
| Stopping | 30 seconds |
| Fixing | 2 minutes |
| Water washing | 5 minutes |
| Drying | |

The following composition was used as a developer and other treating solution was the same as used in Comparative Example—1.

| [Developer composition] | | |
|---|---|---|
| Metol | 5 | g |
| Anhydrous sodium sulfite | 40 | g |
| Sodium carbonate monohydrate | 30 | g |
| Potassium bromide | 2.5 | g |
| 5-Nitrobenzimidazole | 0.5 | g |
| 1-Phenyl-5-mercaptotetrazole | 10 | mg |
| Water to make | 1 | l |
| pH = 10.20 | | |

Example—2

This example was run in the same way as in Example—1 except that the following developing agents were respectively used instead of Metol in the developer used in Example—1.

| | | |
|---|---|---|
| ① | Chlorocatechol (Compound B) | 5 g |
| ② | 4-Aminophenol (Compound E) | 5 g |
| ③ | 4-Amino-3-methyl-N-ethyl-N-(β-hydroxyethyl)-aniline (Compound H) | 8 g |
| ④ | 10 g of sodium ascorbate (Compound D) and 0.5 g of 1-phenyl-3-pyrazolidione (Compound I) | 0.5 g |

Then, respective Samples were exposed in the same way as in Example—1 and treated with the above developer as in Example—1.

The photographic performances of samples obtained by the treatment of Comparative Example—1, Example—1 and Example—2 were measured just after the preparation of the developer and after 24 hours of its preparation. The results were shown in Table 3.

Table 3

| Photographic performance Sample | Just after preparation of the developer γ | Fog | * Dot quality | After 24 hours of preparation of the developer γ | Fog | * Dot quality |
|---|---|---|---|---|---|---|
| Comparative example-1 | 16.2 | 0.04 | 4.0 | 10.1 | 0.04 | 2.0 |
| Example-1 | 18.3 | 0.04 | 4.5 | 17.2 | 0.04 | 4.5 |
| Example-2① (Compound B) | 12.8 | 0.04 | 3.5 | 12.3 | 0.04 | 3.5 |
| Example-2② (Compound E) | 11.7 | 0.05 | 3.5 | 11.0 | 0.05 | 3.5 |
| Example-2③ (Compound H) | 10.8 | 0.05 | 3.5 | 10.2 | 0.05 | 3.5 |
| Example-2④ (Compounds) D + I) | 15.5 | 0.04 | 4.5 | 14.8 | 0.04 | 4.0 |

*"Dot quality" here in the examples of this invention means visually estimated value of reproduced halftone dot images. Halftone images obtained from the exposedand then developed with type light-sensitive photographic material are composed of the part called generally "shadow dot" and the part known as "highlight part". "Dot quality" here means an estimated value of the dot in the part having 50% dot in which a half of a definite area is clear and the rest of it is a developed image and the dot quality is expressed in progressive scale. That is, "4" means excellent and "1" extremely badness. A dot quality below 3 cannot generally be accepted.

It is evident from Table 3 that the light-sensitive silver halide photographic material containing a non-diffusible oxidant according to this invention, when treated according to the treatment of this invention causes an extremely effective increase in contrast. Further, it is generally necessary to maintain an ion concentration of sulfite for formation of dot images of a lith type developer. But the dot images obtained with the treatments of this invention using the light-sensitive material and the developer according to this invention have extremely excellent performance and the developer used in this invention has a very long time of stability compared with a conventional lith type developer.

Comparative Example—2

A silver bromo-iodide gelatin emulsion with an average grain size of 0.6μ containing 97.5 moles % of bromide and 2.5 moles % of iodide was chemically sensitized using sulfur and gold sensitizers. This emulsion was then coated on a polyethylene terephthalate support so as to cover 55 mg of silver/100 $cm^2$ and 40 mg of coated gelatin/100 $cm^2$. Further, on this silver halide emulsion layer was coated gelatin in an amount of 15 mg/100 $cm^2$ as a protective layer. Then, this sample was exposed in the same way as in Example—1 and treated.

Example—3

This example was run in the same way as in Comparative Example—2. But in this example an ion pair composed of 1.5 g of 2,3-diphenyl-5-nitro-2H-tetrazolium chloride and DES per 1 mole of silver was added to the emulsion before coating. Then, this sample was exposed in the same way as in Example—1 and treated in the same way as in Example—1 providing that the following developing agents were added instead of Metol in the developer composition of Example—1:

| | | |
|---|---|---|
| ① | N-Methyl-p-aminophenol (Compound G) | 5 g |
| ② | Catechol (Compound A) | 5 g |
| ③ | 2-Amino-6-phenylphenol (Compound F) | 5 g |
| ④ | 4.5 g of catechol and 0.5 g of N-methyl-p-aminophenol (Compounds A and G) | |

The photographic performances of samples obtained were measured in the same way as in Table 3.

Table 4

| Photographic performance of preparation Sample | After 10 minutes of preparation of the developer γ | Fog | Dot quality | After 24 hours of the developer γ | Fog | Dot quality |
|---|---|---|---|---|---|---|
| Comparative example-2 | 0.8 | 0.40 | 1.0 | 0.2 | 0.45 | 1.0 |
| Example-4① (Compound G) | 17.2 | 0.04 | 4.5 | 16.8 | 0.04 | 4.5 |
| Example-3② (Compound A) | 11.7 | 0.04 | 3.5 | 11.2 | 0.04 | 3.5 |
| Example-3③ (Compound F) | 10.8 | 0.04 | 3.5 | 10.1 | 0.04 | 3.5 |
| Example-3④ (Compound A + G) | 15.2 | 0.04 | 4.0 | 14.5 | 0.04 | 4.0 |

It is evident from Table 4 that the light-sensitive silver halide photographic material containing a non-diffusible oxidant according to this invention has an extremely high-contrast and excellent dot quality and so an excellent aptitude as lith type light-sensitive material. The developer used in this invention has a long time of stability compared with a conventional lith type developer.

Comparative Example—3

A silver bromo-iodide gelatin emulsion with an average grain size of 0.4μ containing 98.5 moles % of bromide and 1.5 moles % of iodide was chemically sensitized using sulfur and gold sensitizers. This emulsion was then coated on a polyethylene support so as to cover 55 mg of silver/100 $cm^2$ and 40 mg of coated gelatin/100 $cm^2$. Before coating, to this emulsion was added 100 mg of 3-(β-hydroxyethyl)-5-[1-naphthyl-4(1H)pyridylidene]rhodanine per 1 mole of silver. Further 15 mg of gelatin per 100 $cm^2$ was coated on the emulsion as a protective layer. Then, this sample was wedge-exposed with a tungsten lamp and treated by the following treatments:

| [Treatment] (at 38° C.) | |
|---|---|
| Development | 45 seconds |
| Fixing | 45 seconds |
| Water washing | 45 seconds |
| Drying | 25 seconds |

The following developer composition was used. The fixing solution was the same as in Comparative Example—1.

| [Developer composition] | |
|---|---|
| Phenidone | 1.0 g |
| Hydroquinone | 9.0 g |
| Sodium sulfite | 50.0 g |
| Anhydrous sodium carbonate | 45.0 g |
| Sodium bromide | 3.0 g |
| Pure water to make | 1. l |

Example—4

This sample was prepared in the same way as in Comparative Example—3. Before coating, an ion pair composed of 0.5 g of hexaammine cobalt chloride [Co(III)$(NH_3)_6Cl_3$] and sodium stearate per 1 mole of silver was added to the emulsion. Then, the sample was exposed in the same way as in Comparative Example—3 and treated with a developer containing the following developing agents:

| [Developing agents] | |
|---|---|
| ①Metol (Compound G) | 5 g |
| ②4-Acetylpyrogallol (Compound C) | 5 g |
| ③p-Aminophenol (Compound E) | 5 g |
| ④3 g of Metol (Compound G) and 2 g of 1-phenyl-3-pyrazolidone (Compund I) | |

The developer composition except developing agents was the same as used in Comparative Example—3. Photographic performances of Comparative Example—3 and Example—4 were measured. The results were shown in Table 5.

Table 5

| Sample | Photographic performance γ | Fog |
|---|---|---|
| Comparative example 3 | 2.5 | 0.06 |
| Example-4① (Compound G) | 4.3 | 0.05 |
| Example-4② (Compound C) | 3.7 | 0.04 |
| Example-4③ (Compound E) | 3.5 | 0.04 |
| Example-4④ (Compound G + I) | 4.0 | 0.04 |

It is evident from Table 5 that the light-sensitive silver halide photographic material containing a non-diffusible oxidant according to this invention when treated by the treatment of this invention gives high-contrast silver images and has excellent photographic characteristics.

Example—5

The development treated sample (Sample No. 1) which was prepared by using the same coating sample as in Comparative Example—1 and by treating with the same treatment and the development treated sample (Sample No. 2) which was prepared by using the same coating sample as in Example—1 and by treating with the same treatment sample was reduced with Sakura R-11 reducer. The reduction was carried out at a room temperature for 30 seconds by using a reducer in which R-11A and B and pure water were mixed in a ratio of 1:1:2 (volumetric ratio) respectively.

The area size of the silver image of the silver image part after reduction of which 70% was clear and 30% was developed and its density were measured by means of a microdensitometer and the results of Table 6 were obtained.

Table 6

| | Area size of silver image after reduction | Density |
|---|---|---|
| Sample No. 1 | about 5% | 1.30 |
| Sample No. 2 | about 5% | 1.70 |

The silver image area having up to 5% of the whole generally affects images after printing and no image can be obtained in the case of below 5% of silver image. But in this case, it is necessary for the density to be over 1.5 and in cases where the density is below 1.5, bad affects result. Therefore, it is evident that the silver image according to this invention is excellent.

Further, it was possible to reduce Sample No. 1 so as not to be below 1.5 of density when the silver image part is below 24%.

Example—6

0.5 g of 2,2',3,3'-tetraphenyl-5,5'-p-phenylene-di (2H-tetrazolium)chloride was dissolved in 3.0 g of fluorinated alcohol (manufactured by Daikin Kokyo Co., Ltd.) and 0.5 g of tricresyl phosphate and mixed with a gelatin solution in Alkanol X C (manufactured by E. I. Du Pont).

This solution was protect-dispersed with a ultrasonic dispersing machine. This dispersed solution was added to an industrial X-ray emulsion containing silver iodobromide in 0.5–0.7$\mu$ of silver diameter. This emulsion was coated on both surfaces of a polyester resin support of which both surfaces were under-coated in an amount of 120 mg/100 cm$^2$ of silver and 4 mg/100 cm$^2$ of the tetrazolium salt per one surface, thus obtaining Sample 1. This Sample was exposed with non-screen as in usual industrial X-ray film and developed with an automatic developing machine (IX-17 manufactured by Konishiroku Photo Industry Co., Ltd.). Sample 2 was prepared and developed in the same way as in Sample 1 except that the tetrazolium salt was not contained. These results were shown in Table 7. Samples 1 and 2 were compared.

The following developer was used

| Developer composition | | |
|---|---|---|
| Water | 500 | ml |
| Hydroxyethylethylenediamine acetate | 1.5 | g |
| Anhydrous sodium sulfite | 50 | g |
| Potassium hydroxide | 16.0 | g |
| Hydroquinone | 25.0 | g |
| a1-Phenyl-3-pyrazolidone | 0.8 | g |
| Potassium carbonate | 13.0 | g |
| Diethyleneglycol | 12.0 | g |
| Triethyleneglycol | 24.0 | g |
| Glutaraldehyde | 5.0 | g |
| Potassium bromide | 6.0 | g |
| Sodium bisulfite | 8.0 | g |
| Glacial acetic acid | 4.7 | g |
| 5-Nitroimidazole | 0.07 | g |
| 1-Phenyl-5-mercaptotetrazole | 0.01 | g |
| Water to make | 1 | l |
| pH = about 10.20 | | |

Table 7

| Sample | Photographic performance γ in straight part | Relative sensitivity | Maximum density | Minimum density |
|---|---|---|---|---|
| I (this invention) | 3.8 | 95 | above 4.0 | 0.02 |
| II (outside of this invention) | 2.7 | 100 | " | 0.04 |

It is evident from Table 7 that the sample of this invention was high in γ in the straight part and low in the minimum density and that the method according to this invention was extremely excellent in forming high-contrast image.

What is claimed is:

1. A process of forming a high-contrast silver image by use of a light-sensitive silver halide photographic material comprising a support, a silver halide emulsion layer and another hydrophilic colloidal layer coated on said support, at least one of said silver halide emulsion layer and said another hydrophilic colloidal layer containing a substantially non-diffusible compound having oxidation power on a hydroquinone developing agent, said substantially non-diffusible compound being selected from the group consisting of (i) a N-chloroarylsulfonamide having the general formula

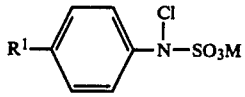

wherein $R^1$ representa an alkyl group having 6–12 carbon atoms and M represents an alkali metal atom, (ii) a bipyridinium compound having the formula $[B]^{2+}(X^-)_2$ wherein $[B]^{2+}$ represents a bipyridinium compound, and $X^-$ represents an anionix surface active moiety having at least 9 carbon atoms, (iii) tetraphenylphosphonium bichromate, (iv) tetraphenylphosphonium permanganate, (v) tetraphenylarsonium perchromate and (vi) a quaternary salt, said quaternary salt being a tetrazolium salt of the following general formulae I, II and III

I

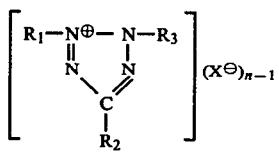

II

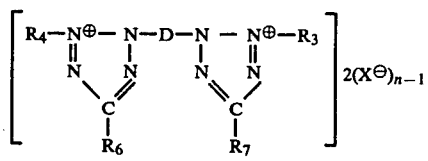

III

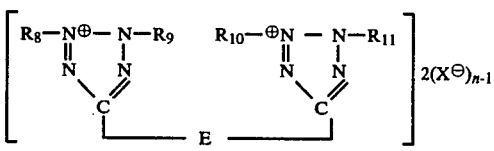

wherein $R_1$, $R_3$, $R_4$, $R_5$, $R_8$, $R_9$, $R_{10}$ and $R_{11}$ each represent an alkyl, allyl, phenyl, naphthyl or heterocyclic group; $R_2$, $R_6$ and $R_7$ each represent an allyl, phenyl, naphthyl, heterocyclic, alkyl or amino group, carboxyl or the salt thereof, mercapto, nitro or hydrogen; D represents an arylene group; E represents an alkylene, allylene or aralkylene group; $X^{\ominus}$ represents an anionic surface active moiety having at least 9 carbon atoms; and n represents an integer of 1 or 2, providing that the compound forms a molecular inner salt when n is 1;

comprising exposing said light-sensitive silver halide photographic material to light;

and developing said exposed photographic material with a developer containing no hydroquinone developing agent, said developer being selected from the group consisting of (A) a compound having the following formula $R_1'—Z—R_2'$ wherein Z is an arylene group; and $R_1'$ and $R_2'$ are individually hydroxyl or an

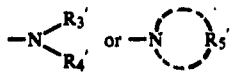

group in which $R_3'$ and $R_4'$ each represent hydrogen, hydroxyl or an alkyl or aryl group, provided that both of $R_1'$ and $R_2'$ cannot simultaneously be hydroxy when $R_1'$ and $R_2'$ are attached to said arylene group of Z in para-position relation; and $R_5'$ is an atomic group for forming a 5- or 6-membered heterocyclic ring, (B) sodium ascorbate, and (C) 1-phenyl-3-pyrazolidone.

2. A process of forming a high-contrast silver image as claimed in claim 1 in which said compound (A) is selected from the group consisting of catechol, 4-chlorocatechol, 4-acetylpygallol, 4-aminophenol, 2-amino-6-phenylphenol, N-methyl-p-aminophenol and 4-amino-3-methyl-N-ethyl-N-(β-hydroxyethyl)-aniline.

3. A process of forming a high-contrast silver image as claimed in claim 1 in which an anion part of said quaternary salt is selected from the group consisting of a higher alkylbenzenesulfonic acid anion, a higher allyl sulfate, a boron system anion, a dialkyl sulfosuccinate anion, a polyetheralcohol, polyetheralcohol sulfate anion, a higher fatty acid anion and a polyacrylic acid anion.

4. A process of forming a high-contrast silver image as claimed in claim 1 in which said hydrophilic colloidal layer is a gelatin layer.

5. A process of forming a high-contrast silver image as claimed in claim 1 in which said developer comprises more than 15 g of a sulfite in 1 l of said developer and a pH value in said developer is at a range of 9.5 to 11.0.

6. A process of forming a high-contrast silver image as claimed in claim 1 in which an average grain size of the silver halide contained in said silver halogen emulsion layer is at a range of 0.015–1.5μ.

7. A process of forming a high-contrast silver image as claimed in claim 1 in which said support is a polyethylene terephthalate support.

8. A process of forming a high-contrast silver image as claimed in claim 1 in which said hydrophilic colloidal layer containing a substantially non-diffusible compound having oxidation power on a hydroquinone developing agent is a silver halide emulsion layer and/or a gelatin layer adjacent to said silver halide emulsion layer.

* * * * *

UNITED STATES PATENT AND TRADEMARK OFFICE

CERTIFICATE OF CORRECTION

PATENT NO. : 4,192,682

DATED : March 11, 1980

INVENTOR(S) : YOSHIO NISHINA et al

It is certified that error appears in the above—identified patent and that said Letters Patent is hereby corrected as shown below:

Column 6, line 10: replace "3,5-Diphenyl-2-(triazin-2H-tetrazolium" with --3,5-Diphenyl-2-(triazin-2-yl)-2H-tetrazolium--.

Column 11, line 60: rewrite "dye, mordant" as --dyes, mordants--.

Column 17, line 36: rewrite "smaller amount" as --(smaller amount)--.

Column 18, line 24: rewrite "vigrous" as --vigorous--.

Column 20, line 24: rewrite "badness" as --bad--.

Column 21, line 5: in the headings for Table 4, "of preparation" should be deleted in the first column and inserted after "After 24 hours" in the last column.

Column 21, third line of the first column in Table 4:

"Example-4-① " should read -- Example-3-① --.

Column 22, line 10: "(Compund I)" should read --(Compound I)--.

Column 23, line 38: "al-Phenyl-3-pyrazolidone" should read --1-Phenyl-3-pyrazolidone--.

Signed and Sealed this

*Twenty-fifth* Day of *May 1982*

[SEAL]

*Attest:*

*Attesting Officer*

GERALD J. MOSSINGHOFF

*Commissioner of Patents and Trademarks*